US008335332B2

(12) United States Patent
Aboulnasr et al.

(10) Patent No.: US 8,335,332 B2
(45) Date of Patent: Dec. 18, 2012

(54) FULLY LEARNING CLASSIFICATION SYSTEM AND METHOD FOR HEARING AIDS

(75) Inventors: Tyseer Aboulnasr, Kanata (CA); Eghart Fischer, Schwabach (DE); Christian Giguère, Ottawa (CA); Wail Gueaieb, Orleans (CA); Volkmar Hamacher, Neunkirchen am Brand (DE); Luc Lamarche, Ottawa (CA)

(73) Assignees: Siemens Audiologische Technik GmbH, Erlangen (DE); University Of Ottawa, Ontario (CA)

( * ) Notice: Subject to any disclaimer, the term of this patent is extended or adjusted under 35 U.S.C. 154(b) by 295 days.

(21) Appl. No.: 12/665,793

(22) PCT Filed: Jun. 23, 2008

(86) PCT No.: PCT/EP2008/057919

§ 371 (c)(1),
(2), (4) Date: May 14, 2010

(87) PCT Pub. No.: WO2008/155427

PCT Pub. Date: Dec. 24, 2008

(65) Prior Publication Data

US 2011/0123056 A1 May 26, 2011

(51) Int. Cl.
*H04R 25/00* (2006.01)

(52) U.S. Cl. ..... 381/314; 381/312; 381/310; 381/317; 381/320; 381/321; 704/200.1; 704/255; 704/256.1; 704/271

(58) Field of Classification Search ..... 381/60, 381/312, 314, 310, 91, 92, 315, 320, 321, 381/323, 23.1, 313, 317; 704/200.1, 255, 704/256, 256.1, 271
See application file for complete search history.

(56) References Cited

U.S. PATENT DOCUMENTS

| | | | | |
|---|---|---|---|---|
| 5,701,398 | A * | 12/1997 | Glier et al. | 706/41 |
| 6,035,050 | A | 3/2000 | Weinfurtner et al. | |
| 6,922,482 | B1 * | 7/2005 | Ben-Porath | 382/149 |
| 7,085,685 | B2 | 8/2006 | Poluzzi et al. | |
| 7,319,769 | B2 * | 1/2008 | Allegro-Baumann et al. | 381/312 |
| 2002/0019826 | A1 * | 2/2002 | Tan | 707/102 |
| 2004/0131195 | A1 | 7/2004 | Mergell | |
| 2006/0126872 | A1 | 6/2006 | Allegro-Baumann et al. | |
| 2007/0269064 | A1 * | 11/2007 | Allegro-Baumann et al. | 381/313 |

FOREIGN PATENT DOCUMENTS

| | | | |
|---|---|---|---|
| EP | 1 395 080 | A1 | 3/2004 |
| EP | 1 404 152 | A2 | 3/2004 |

(Continued)

OTHER PUBLICATIONS

Same et al, A Mixture Model Approach for Online Clustering , Compstat 2004.*

(Continued)

*Primary Examiner* — Walter F Briney, III
*Assistant Examiner* — Kuassi Ganmavo
(74) *Attorney, Agent, or Firm* — Schiff Hardin LLP

(57) ABSTRACT

A method for operating a hearing aid in a hearing aid system where the hearing aid is continuously learnable for the particular user. A sound environment classification system is provided for tracking and defining sound environment classes relevant to the user. In an ongoing learning process, the classes are redefined based on new environments to which the hearing aid is subjected by the user.

4 Claims, 3 Drawing Sheets

FOREIGN PATENT DOCUMENTS

EP 1 670 285 A2 6/2006

OTHER PUBLICATIONS

Kim et al, On Adaptively Learning HMM-Based Classifiers Using Split-Merge Operations, Springer Verlag,2006.*
Singh et al, Structure Redefinition of Sound Units by Merging and Splitting for Improved Speech Recognition.*
Mozer et al, Dynamic On-line Clustering and State Extraction an Approach to Symbolic Learning, 1998.*
Data Clustering: A Review—Jain—XP-002165131—ACM Computing Surveys, vol. 31, No. 3 Sep. 1999.
Fitting Strategies for Multiple-Memory Programmable Hearing Instruments—Stypulkowski Jul. 1993 AJA.
Identification of Noises by Neural nets for Application in Hearing Aids—Feldbusch—Jan. 1995.
Hearing Aids—Harvey Dillon, Ph.D—2001.
An Efficient Robust Sou8nd Classification Algorithm for Hearing Aids—Nordqvist Apr. 3, 2001.
Algorithms for Sound Classification in Hearing Instruments—2002.
DataLogging: A Clinical Tool for Meeting Individual Patent Needs—Jan. 2005.
Sound Classification in Hearing Aids Inspired by Auditory Scene Analysis—Büchler—2005.

* cited by examiner a) Training data for initial classification
b) Test data for adaptive learning algorithm
c) After splitting two times
d) After merging of two classes

Fully Learning Classification System And Method

FULLY LEARNING CLASSIFICATION SYSTEM AND METHOD FOR HEARING AIDS

BACKGROUND

Hearing aids are customized for the user's specific type of hearing loss and are typically programmed to optimize each user's audible range and speech intelligibility. There are many different types of prescription models that may be used for this purpose (H. Dillon, *Hearing Aids*, Sydney: Boomerang Press 2001), the most common ones being based on hearing thresholds and discomfort levels. Each prescription method is based on a different set of assumptions and operates differently to find the optimum gain-frequency response of the device for a given user's hearing profile. In practice, the optimum gain response depends on many other factors such as the type of environment, the listening situation and the personal preferences of the user. The optimum adjustment of other components of the hearing aid, such as noise reduction algorithms and directional microphones, also depend on the environment, specific listening situation and user preferences. It is therefore not possible to optimize the listening experience for all environments using a fixed set of parameters for the hearing aid. It is widely agreed that a hearing aid that changes its algorithm or features for different environments would significantly increase the user's satisfaction (D. Fabry, and P. Stypulkowski, Evaluation of Fitting Procedures for Multiple-memory Programmable Hearing Aids.—paper presented at the annual meeting of the American Academy of Audiology, 1992). Currently this adaptability typically requires the user's interaction through the switching of listening modes.

It is presently known that classification systems and methods for hearing aids are based on a set of fixed acoustical situations ("classes") that are described by the values of some features and detected by a classification unit. The detected classes 10, 11, and 12 are mapped to respective parameter settings 13, 14, and 15 in the hearing aid that may be also fixed (FIG. 1) or may be changed ("trained") (FIG. 2 as shown at 16, 17, and 18 respectively) by the hearing aid user, ("trainable hearing aid").

New hearing aids are now being developed with automatic environmental classification systems which are designed to automatically detect the current environment and adjust their parameters accordingly. This type of classification typically uses supervised learning with predefined classes that are used to guide the learning process. This is because environments can often be classified according to their nature (speech, noise, music, etc.). A drawback is that the classes must be specified a priori and may or may not be relevant to the particular user. Also there is little scope for adapting the system or class set after training or for different individuals.

EP-A-1 395 080 discloses a method for setting filters for audio processing (beam forming) wherein a clustering algorithm is used to distinguish acoustic scenarios (different noise situations). The acoustic scenario clustering unit monitors the acoustic scenario. As soon as they change and the acoustic scenario is detected, a learning phase is initiated and a new scenario is determined with the help of a clustering training (FIG. 8, reference numeral 57). The end result is a new scenario wherein the corresponding class replaces the previous one, i.e. deletion of a class.

EP-A-1 670 285 shows a method to adjust parameters of a transfer function of a hearing aid having a feature extractor and a classifier.

EP-A-1 404 152 discloses a hearing aid device that adapts itself to the hearing aid user by means of a continuous weighting function that passes through various data points which respectively represent individual weightings of predetermined acoustic situations. New classes are added but ones not used are not deleted.

SUMMARY

It is an object to provide a hearing aid system and method which does not have unchanging fixed classes and is learnable as to a specific user.

A method for operating a hearing aid in a hearing aid system where the hearing aid is continuously learnable for the particular user. A sound environment classification system is provided for tracking and defining sound environment classes relevant to the user. In an ongoing learning process, the classes are redefined based on new environments to which the hearing aid is subjected by the user.

DESCRIPTION OF THE PREFERRED EMBODIMENT

Figure 1:
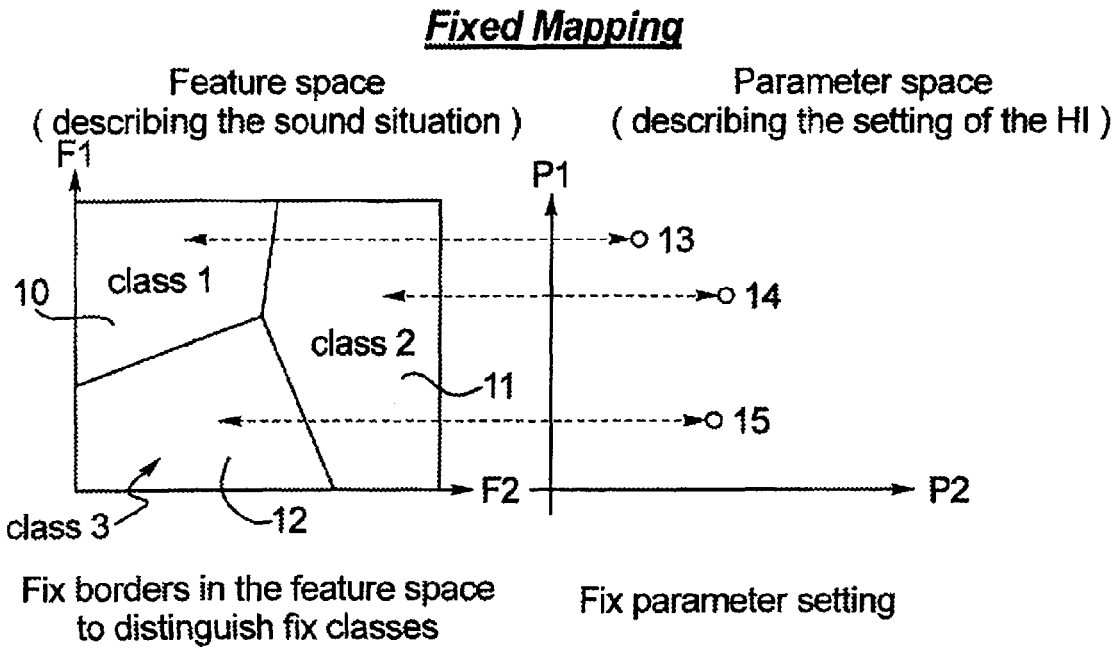
FIG. 1 (PRIOR ART)
FIG. 1 illustrates a fixed mapping with a feature space and a parameter space according to the prior art.
Figure 2:
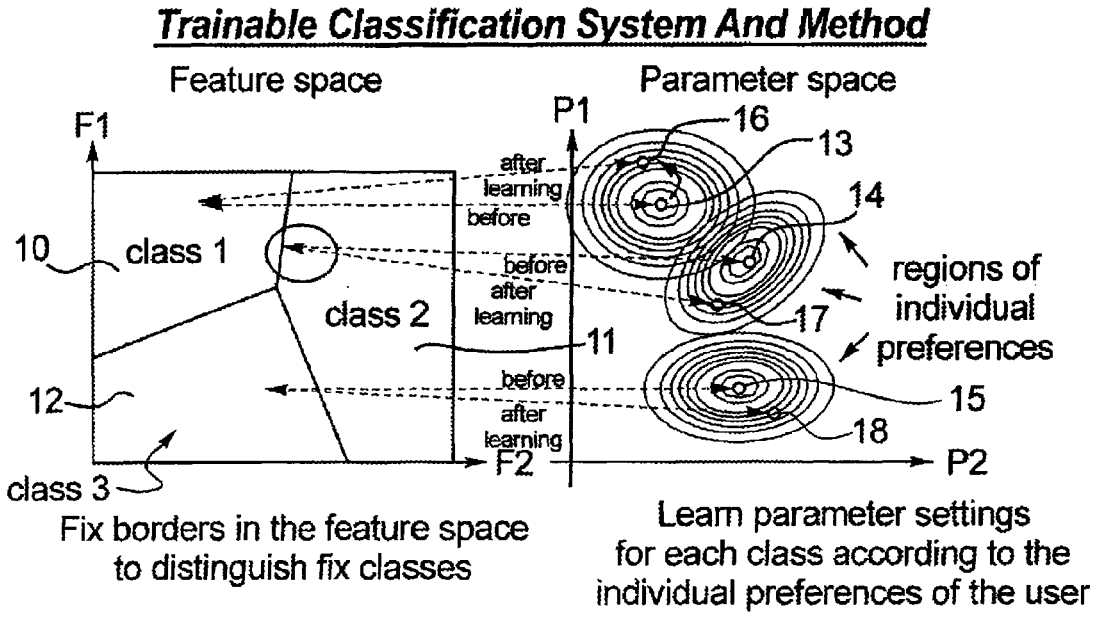
FIG. 2 (PRIOR ART)
FIG. 2 illustrates a trainable classification with a feature space and a parameter space according to the prior art.

For the purposes of promoting an understanding of the principles of the invention, reference will now be made to the preferred embodiment/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

An adaptive environmental classification system is provided in which classes can be split and merged based on changes in the environment that the hearing aid encounters. This results in the creation of classes specifically relevant to the user. This process continues to develop during the use of the hearing aid and therefore adapts to evolving needs of the user.

Overall System

Figure 3:
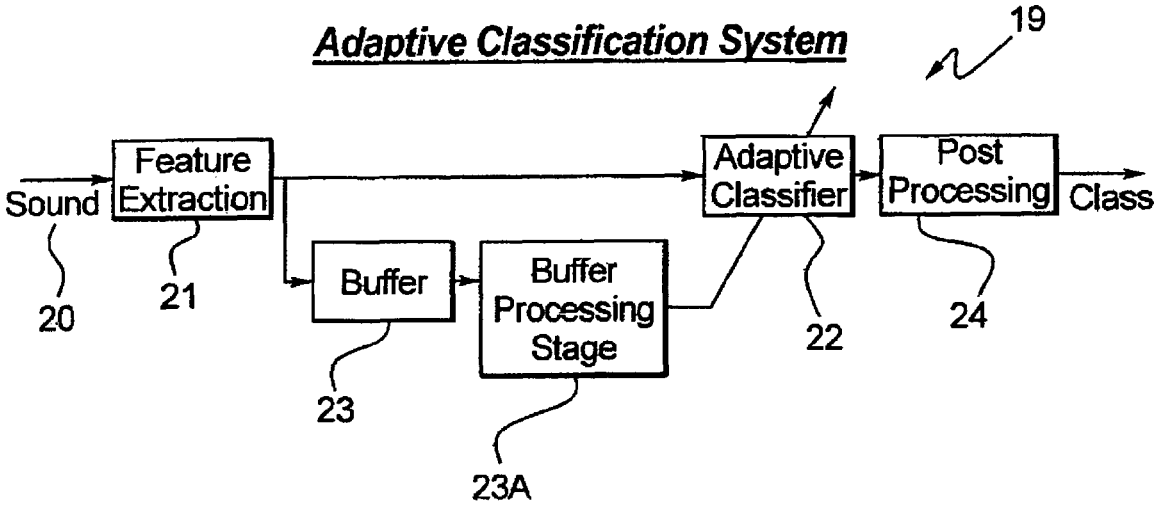
FIG. 3 illustrates an adaptive classification system employed with the system and method of the preferred embodiment.

FIG. 3 shows a block diagram at 19 for the adaptive classification system. First, the sound signal 20 received by the hearing aid is sampled and converted into a feature vector via feature extraction 21. This step is a very crucial stage of classification since the features contain the information that will distinguish the different types of environments (M. Büchler, "Algorithms for Sound Classification in Hearing Instruments," PhD Thesis at Swiss Federal Institute of Technology, Zurich, 2002, no 14498). The resulting classification accuracy highly depends on the selection of features. The feature vector is then passed on to the adaptive classifier 22 to be assigned into a class, which in turn will determine the hearing aid setting. However, the system also stores the features in a buffer 23 which is periodically processed at buffer processing stage 23A to provide a single representative feature vector for the adaptive learning process. Finally, the post processing step 24 acts as a filter, to remove spurious jumps in classifications to yield a smooth class transition. The buffer 23 and adaptive classifier 22 are described in more detail below.

Buffer

The buffer 23 comprises an array that stores past feature vectors. Typically, the buffer 23 can be 15-60 seconds long depending on the rate at which the adaptive classifier 22 needs to be updated. This allows the adaptation of the classifier 22 to run at a much slower rate than the ongoing classification of input feature vectors. The buffer processing stage 23A calculates a single feature vector to represent all of the unbuffered data, allowing a more accurate assessment of the acoustical characteristics of the current environment for the purpose of adapting the classifier 22.

Adaptive Classifier

The adaptive classification system is divided into two phases. The first phase, the initial classification system, is the starting point for the adaptive classification system when the hearing aid is first used. The initial classification system organizes the environments into four classes: speech, speech in noise, noise, and music. This will allow the user to take home a working automatic classification hearing aid. Since the system is being trained to recognize specific initial classes, a supervised learning algorithm is appropriate.

The second phase is the adaptive learning phase which begins as soon as the user turns the hearing aid on following the fitting process, and modifies the initial classification system to adapt to the user-specific environments. The algorithm continuously monitors changes in the feature vectors. As the user enters new and different environments the algorithm continuously checks to determine if a class should split and/or if two classes should merge together. In the case where a new cluster of feature vectors is detected and the algorithm decides to split, an unsupervised learning algorithm is used since there is no a priori knowledge about the new class.

Test Results

Figure 4:
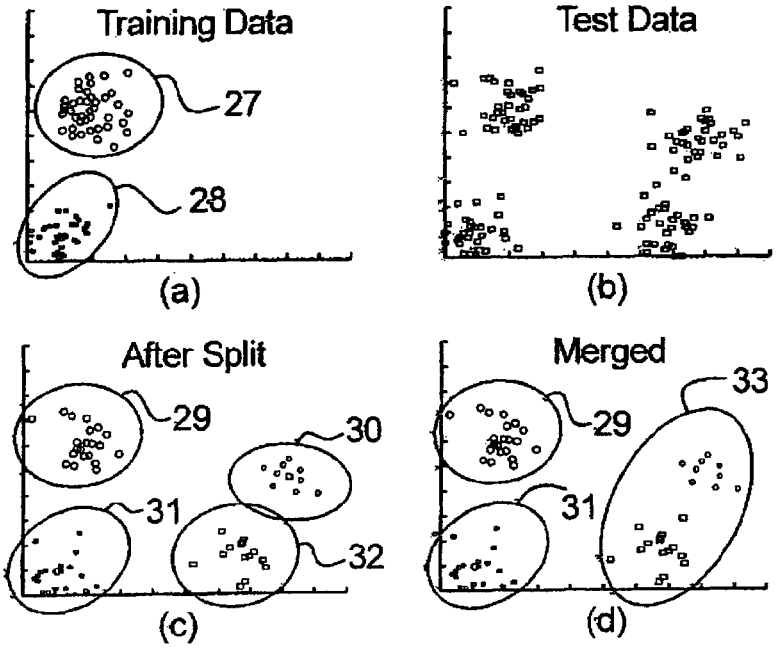
FIG. 4 are a compilation of graphs illustrating training data for initial classification, test data for adaptive learning algorithm, an illustration after splitting two times, and an illustration after merging of two classes.

The following example illustrates the general behavior of the adaptive classifier and the process of splitting and merging environment classes. The initial classifier is trained with two ideal classes, meaning the classes have very defined clusters in the feature space as seen in FIG. 4 (graph (a)). These two classes represent the initial classification system. FIG. 4 (graph (b)) shows the test data that will be used for testing the adaptive learning phase. As the figure shows, there are four clusters present, two of which are very different than the initial two in the feature space. The task for the algorithm is to detect these two new clusters as being new classes. To demonstrate the merging process, the maximum number of classes is set to three. Therefore two of the classes must merge once the fourth class is detected.

Splitting

While introducing the test data, a split criterion is continuously monitored and checked until enough data lies outside of the cluster area. This sets a flag that then triggers the algorithm to split the class 27 or 28 (FIG. 4 (graph (a)) into two classes 29, 30 or 31, 32. FIG. 4 (graph (c)) shows the data after the algorithm has split and detected the two new classes 29, 30 or 31, 32.

Merging

Once the fourth cluster is detected and the splitting process occurs, as shown in FIG. 4 (graph (c)), the merging process begins where two classes 30, 32 must merge into one class 33. FIG. 4 (graph (d)) shows the two closest clusters merging into one, thus resulting with three classes, the maximum set in this example.

According to the preferred embodiment, a system is provided that does not have pre-defined fixed classes but is able—by using a common clustering algorithm that is running in the background—to find classes for itself and is also able to modify, delete and merge existing ones dependent on the acoustical environment the hearing aid user is in.

All features used for classification are forming a n-dimensional feature space; all parameters that are used to configure the hearing aid are forming a m-dimensional feature space; n and m are not necessarily equal.

Starting with one or more pre-defined classes and one or more corresponding parameter sets that are activated according to the occurrence of the classes, the system and method continuously analyzes the distribution of feature values in the feature space (using common clustering algorithms, known from literature) and modifies the borders of the classes accordingly, so that preferably always one cluster will represent one class. If two distinct clusters are detected within one existing class, the class will be split into two new classes. If one cluster is covering two existing classes, the two classes will be merged to one new class. There may be an upper limit fo the total number of classes, so that whenever a new class is built, two old ones have to be merged.

At the same time the parameter settings, representing possible user input, are clustered and a mapping to the current clusters in feature space is calculated, according to which parameter setting is used in which acoustical surround: One cluster in parameter space can belong to one or more clusters in feature space for the case that the same setting is chosen for different environments.

Figure 5:
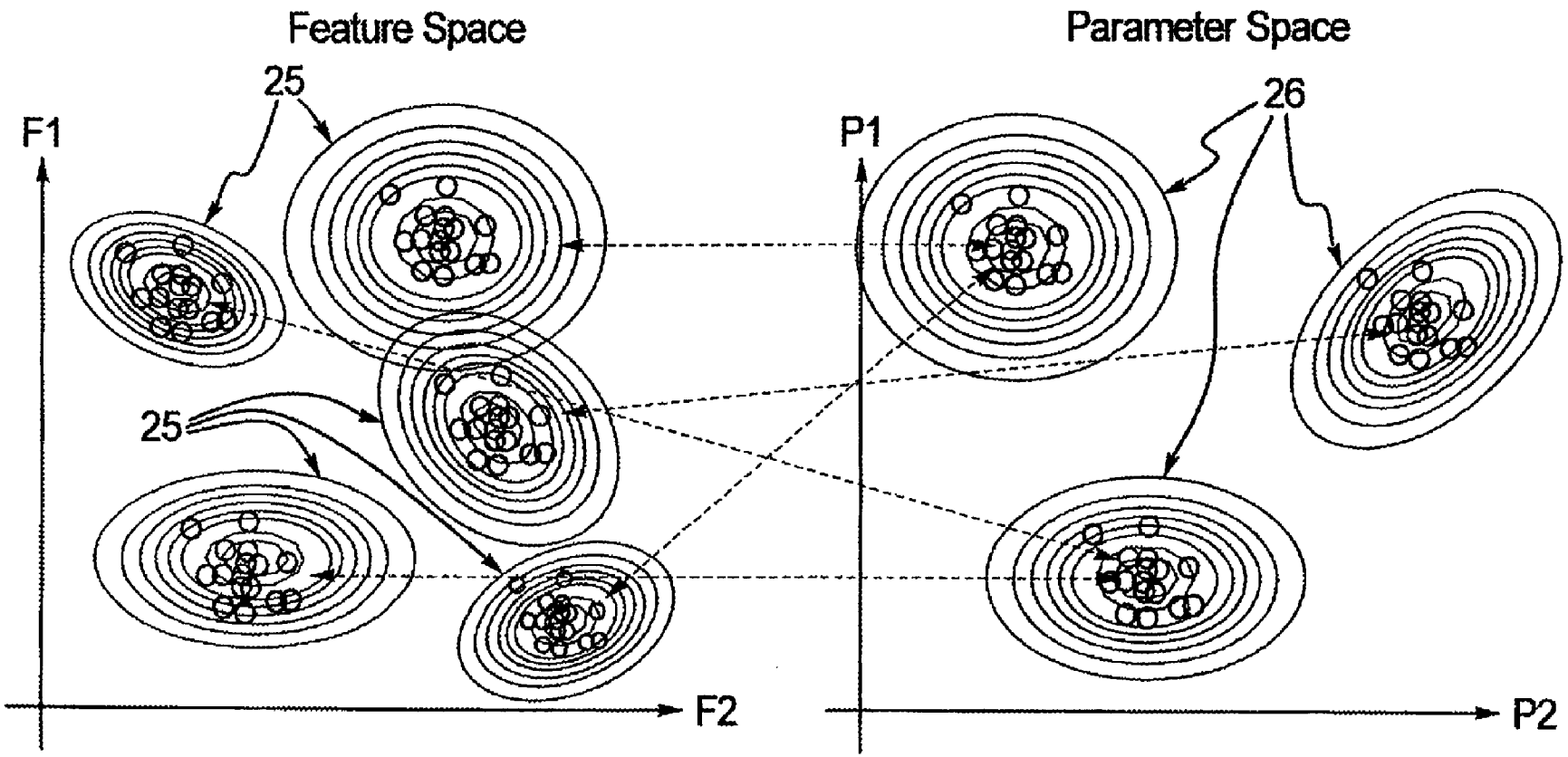
FIG. 5 illustrates a fully learning classification system and method with a feature space and a parameter space.

The result is a dynamic mapping between dynamically changing clusters 25 in feature space (depending on individual acoustic surroundings) and corresponding clusters 26 in parameter space (depending on the individual users' preferences) is the result of this system and method. This is illustrated in FIG. 5.

A new adaptive classification system is provided for hearing aids which allows the device to track and define environmental classes relevant to each user. Once this is accomplished the hearing aid may then learn the user preferences (volume control, directional microphone, noise reduction, spectral balance, etc.) for each individual class.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim as our invention:

1. A method for operating a hearing aid, comprising the steps of:

using a clustering algorithm to find at least one or more hearing environment classes based on feature values in a feature space describing sound situations to which the hearing aid is subjected;

activating one or more corresponding parameter sets in a parameter space for said hearing aid according to occurrence of the found classes;

in an ongoing learning process, redefining at least one or more of the found classes by at least one of modifying, deleting or merging the one or more found classes dependent on an acoustical environment of a user of the hearing aid, and including continuously analyzing a distribution of said feature values in said feature space and modifying borders of the classes so that one cluster will represent one class; and performing at least one of the following steps selected from the group consisting of if two distinct clusters are detected within one found class, the class is split into two new classes permitting the hearing aid to set a corresponding different parameter set for each of said two new classes, and if one cluster is covering two found classes, the two classes are merged to one new class permitting the hearing aid to set a corresponding new parameter set for the one new class.

2. A method of claim 1 wherein a dynamic mapping occurs between dynamically changing clusters in the feature space depending on individual acoustic surroundings and corresponding clusters in the parameter space depending on individual user preferences.

3. A hearing aid system, comprising:

a sound environment classification system for tracking and defining sound environment classes relevant to a user of the hearing aid and which uses a clustering algorithm to find at least one or more hearing environment classes based on feature values in a feature space describing sound situations to which the hearing aid is subjected, and activating one or more corresponding parameter sets in a parameter space for said hearing aid according to occurrence of the found classes; and an ongoing learning system in which the hearing aid redefines at least one or more of the found classes based on new environments to which the hearing aid is subjected by the user, said ongoing learning system at least one of modifying, deleting or merging the one or more found classes dependent on an acoustical environment of a user of the hearing aid, and including continuously analyzing a distribution of said feature values in said feature space and modifying borders of the classes so that one cluster will represent one class, and performing at least one of the following steps selected from the group consisting of if two distinct clusters are detected within one found class, the class is split into two new classes permitting the hearing aid to set a corresponding different parameter set for each of said two new classes, and if one cluster is covering two found classes, the two classes are merged to one new class permitting the hearing aid to set a corresponding new parameter set for the one new class.

4. A non-transitory computer-readable storage medium comprising a computer program for a hearing aid that performs the steps of:

using a clustering algorithm to find at least one or more hearing environment classes based on feature values in a feature space describing sound situations to which the hearing aid is subjected;

activating one or more corresponding parameter sets in a parameter space for said hearing aid according to occurrence of the found classes;

in an ongoing learning process, redefining the at least one or more of the found classes by at least one of modifying, deleting or merging the one or more found classes dependent on an acoustical environment of a user of the hearing aid, and including continuously analyzing a distribution of said feature values in said feature space and modifying borders of the classes so that one cluster will represent one class; and performing at least one of the following steps selected from the group consisting of if two distinct clusters are detected within one found class, the class is split into two new classes permitting the hearing aid to set a corresponding different parameter set for each of said two new classes, and if one cluster is covering two found classes, the two classes are merged to one new class permitting the hearing aid to set a corresponding new parameter set for the one new class.

* * * * *